US007637442B2

(12) United States Patent
Aoki et al.

(10) Patent No.: US 7,637,442 B2
(45) **Date of Patent: *Dec. 29, 2009**

(54) FUEL INJECTION VALVE

(75) Inventors: Ryuji Aoki, Miyagi (JP); Daisuke Sato, Miyagi (JP); Atsushi Kamahora, Miyagi (JP); Akira Arioka, Miyagi (JP)

(73) Assignee: Keihin Corporation, Tokyo (JP)

( * ) Notice: Subject to any disclaimer, the term of this patent is extended or adjusted under 35 U.S.C. 154(b) by 136 days.

This patent is subject to a terminal disclaimer.

(21) Appl. No.: 11/885,987

(22) PCT Filed: Mar. 7, 2006

(86) PCT No.: PCT/JP2006/304314

§ 371 (c)(1),
(2), (4) Date: Sep. 10, 2007

(87) PCT Pub. No.: WO2006/095706

PCT Pub. Date: Sep. 14, 2006

(65) Prior Publication Data

US 2008/0203194 A1 Aug. 28, 2008

(30) Foreign Application Priority Data

Mar. 9, 2005 (JP) ..... 2005-065800
Mar. 14, 2005 (JP) ..... 2005-071651
Mar. 14, 2005 (JP) ..... 2005-071652

(51) Int. Cl.
*F02M 61/00* (2006.01)

(52) U.S. Cl. ..... 239/533.12; 239/533.1; 239/533.2; 239/533.3; 239/533.14; 239/596

(58) Field of Classification Search ..... 239/533.1, 239/533.2, 533.3, 533.12, 533.14, 543, 596; 123/531, 533, 585, 467
See application file for complete search history.

(56) References Cited

U.S. PATENT DOCUMENTS 5,129,381 A * 7/1992 Nakajima ..... 123/531
6,817,545 B2 * 11/2004 Xu ..... 239/533.12
6,854,670 B2 * 2/2005 Sumisha et al. ..... 239/543
7,007,864 B2 * 3/2006 Snyder et al. ..... 239/105
RE40,199 E * 4/2008 Sugimoto et al. ..... 239/596
7,530,508 B2 * 5/2009 Sato et al. ..... 239/596

(Continued)

FOREIGN PATENT DOCUMENTS

JP 9-506409 A 6/1997

(Continued)

*Primary Examiner*—Dinh Q Nguyen
*Assistant Examiner*—Trevor E McGraw
(74) *Attorney, Agent, or Firm*—Arent Fox LLP

(57) ABSTRACT

A fuel injection valve is provided that includes a valve seat member (3) having a conical valve seat (8) and a valve hole (7) formed through a central part of the valve seat (8), a valve body (18) working in cooperation with the valve seat (8), and an injector plate (10) joined to the valve seat member (3) and having a plurality of fuel injection holes (11) radially outwardly displaced from the valve hole (7), a diffusion chamber (39) providing communication between the valve hole (7) and the fuel injection holes (11) being provided between the valve seat member (3) and the injector plate (10), wherein the diffusion chamber (39) formed between the valve seat member (3) and the injector plate (10) is in an annular shape, has a diameter that is larger than that of the valve hole (7), and has inner ends of the fuel injection holes (11) opening therein, and a plurality of fuel passages (42*a*, 42*b*) are disposed within the valve hole (7), the plurality of fuel passages (42*a*, 42*b*) reversing within the valve hole (7) fuel that has passed through the valve seat (8) and guiding the fuel to the diffusion chamber (39). This enables atomization of injected fuel to be promoted and penetrability to be improved for the fuel injection valve.

15 Claims, 12 Drawing Sheets

U.S. PATENT DOCUMENTS

| | | | | |
|---|---|---|---|---|
| 2002/0063175 | A1* | 5/2002 | Kitamura et al. | 239/585.1 |
| 2002/0125343 | A1* | 9/2002 | Yildirim et al. | 239/533.2 |
| 2003/0111544 | A1 | 6/2003 | Moorthy et al. | |
| 2005/0023381 | A1* | 2/2005 | Xu | 239/533.2 |
| 2005/0087629 | A1* | 4/2005 | Sayar | 239/533.12 |
| 2005/0087630 | A1* | 4/2005 | Sayar | 239/533.12 |
| 2006/0065763 | A1* | 3/2006 | Akabane | 239/533.2 |
| 2006/0138255 | A1* | 6/2006 | Nakatsu et al. | 239/533.2 |
| 2007/0272774 | A1* | 11/2007 | Sato et al. | 239/585.4 |

FOREIGN PATENT DOCUMENTS

| | | | |
|---|---|---|---|
| JP | 10-506695 | A | 6/1998 |
| JP | 2000-508739 | A | 7/2000 |
| JP | 2002-04983 | A | 1/2002 |
| JP | 2002-130074 | A | 5/2002 |
| JP | 2004-278464 | A | 10/2004 |
| JP | 2005-54656 | A | 3/2005 |

* cited by examiner

FUEL INJECTION VALVE

TECHNICAL FIELD

The present invention mainly relates to a fuel injection valve used in a fuel supply system of an internal combustion engine and, in particular, to an improvement of a fuel injection valve that includes a valve seat member having a conical valve seat and a valve hole formed through a central part of the valve seat, a valve body for opening and closing the valve hole in cooperation with the valve seat, and an injector plate joined to the valve seat member and having a plurality of fuel injection holes radially outwardly displaced from the valve hole, a diffusion chamber providing communication between the valve hole and the fuel injection holes being provided between the valve seat member and the injector plate.

BACKGROUND ART

Such a fuel injection valve is already known, as disclosed in Patent Publication 1 below.

Patent Publication 1: Japanese Patent Application Laid-open No. 2002-130074

DISCLOSURE OF INVENTION

Problems to be Solved by the Invention

In recent years, the demand for internal combustion engines that have low fuel consumption and lower pollution has been ever increasing. In order to lower the engine fuel consumption and clean the exhaust gas, it is important for a fuel injection valve to atomize injected fuel and have penetrability (power to pass through) in order for the attachment of fuel onto an inner wall of an intake path to be suppressed.

The present invention has been accomplished under such circumstances, and it is an object thereof to provide a fuel injection valve that can minimize the dead volume of a fuel passage from a valve seat to a fuel injection hole and minimize the pressure loss of fuel in the fuel passage, thus atomizing the injected fuel and improving the penetrability.

Means for Solving the Problems

In order to attain the above object, according to a first aspect of the present invention, there is provided a fuel injection valve comprising a valve seat member having a conical valve seat and a valve hole formed through a central part of the valve seat, a valve body for opening and closing the valve hole in cooperation with the valve seat, and an injector plate joined to the valve seat member and having a plurality of fuel injection holes radially outwardly displaced from the valve hole, a diffusion chamber providing communication between, the valve hole and the fuel injection holes being provided between the valve seat member and the injector plate, characterized in that the diffusion chamber formed between the valve seat member and the injector plate is in an annular shape, has a diameter that is larger than that of the valve hole, and has inner ends of the fuel injection holes opening therein, and a plurality of fuel passages are disposed within the valve hole, the plurality of fuel passages reversing within the valve hole fuel that has passed through the valve seat and guiding the fuel to the diffusion chamber.

According to a second aspect of the present invention, in addition to the first aspect, the annular diffusion chamber has an outer peripheral wall formed from the valve seat member, and has an inner peripheral wall formed from a fuel guide member connected to the injector plate so as to face the valve hole, and the plurality of fuel passages are formed in the fuel guide member.

According to a third aspect of the present invention, in addition to the second aspect, the fuel passages are formed from cutouts provided in the outer periphery of the fuel guide member.

According to a fourth aspect of the present invention, in addition to the third aspect, the valve seat and the cutouts are disposed so that an extension of the generatrix of the conical valve seat intersects an inner face of the cutouts.

According to a fifth aspect of the present invention, in addition to the first to fourth aspects, when the effective diameter of the valve seat is D1, and the diameter of the valve hole is D2, D1 and D2 are set so as to make $1<D1/D2\leqq 1.5$.

According to a sixth aspect of the present invention, in addition to the second to fifth aspects, the fuel guide member is inserted into the valve hole.

According to a seventh aspect of the present invention, in addition to the second to sixth aspects, when the height of the diffusion chamber is H1, and the thickness of the fuel guide member is H2, H1 and H2 are set so as to make $H2/H1\geqq 1.5$.

According to an eighth aspect of the present invention, in addition to the sixth or seventh aspect, an end face of the fuel guide member facing the valve hole is formed so as to follow an end face of the valve body facing the valve hole.

According to a ninth aspect of the present invention, in addition to the second to eighth aspects, the fuel guide member is produced by press forming and is joined to the injector plate by spot-welding by means of a laser from an outer face side of the injector plate.

According to a tenth aspect of the present invention, there is provided a fuel injection valve comprising a valve seat member having a conical valve seat and a valve hole formed through a central part of the valve seat, a valve body for opening and closing the valve hole in cooperation with the valve seat, and an injector plate joined to the valve seat member and having a plurality of fuel injection holes radially outwardly displaced from the valve hole, a diffusion chamber providing communication between the valve hole and the fuel injection holes being provided between the valve seat member and the injector plate, characterized in that a fuel guide member facing the valve hole is connected to the injector plate, the diffusion chamber formed between the valve seat member and the injector plate is in an annular shape, is faced by an outer peripheral face of the fuel guide member, has a diameter that is larger than that of the valve hole, and has inner ends of the fuel injection holes opening therein, the fuel guide member has formed in an outer peripheral portion a plurality of blocking portions partially blocking the valve hole and a plurality of cutouts that are present between these blocking portions and provide communication between the valve hole and the diffusion chamber, and these cutouts are disposed so as to circumscribe an imaginary circle having the center thereof on an axis of the valve seat member.

According to an eleventh aspect of the present invention, in addition to the tenth aspect, the plurality of fuel injection holes are divided into two groups disposed symmetrically relative to one diameter of the injector plate, the fuel guide member is provided with first cutouts having a large cutout area and corresponding to a region in which a plurality of the fuel injection holes in a middle section of each of the groups are arranged, and second cutouts having a small cutout area and being positioned on the diameter so as to face in opposite directions to each other, and the fuel injection holes in the outside section of each of the groups are disposed so as to face the respective blocking portions adjacent to the second cutouts.

According to a twelfth aspect of the present invention, in addition to the eleventh aspect, when the total aperture area of the first cutouts is S1, the total aperture area of the second cutouts is S2, the valve-opening area between the valve seat and the valve body is S3, and the total aperture area of the fuel injection holes is S4, S1 to S4 are set so as to make (S1+S2) >S3>S4.

According to a thirteenth aspect of the present invention, in addition to the eleventh or twelfth aspect, there are a plurality of the fuel injection holes arranged in the middle section of each of the groups, one of the fuel injection holes is positioned in each of opposite outside sections of each of the groups, and the cutout width of the first cutout is set larger than the cutout width of the second cutout.

According to a fourteenth aspect of the present invention, there is provided a fuel injection valve comprising a valve seat member having a conical valve seat and a valve hole formed through a central part of the valve seat, a valve body for opening and closing the valve hole in cooperation with the valve seat, and an injector plate joined to the valve seat member and having a plurality of fuel injection holes radially outwardly displaced from the valve hole, a diffusion chamber providing communication between the valve hole and the fuel injection holes being provided between the valve seat member and the injector plate, characterized in that a fuel guide member facing the valve hole is connected to the injector plate, the diffusion chamber formed between the valve seat member and the injector plate is in an annular shape, is faced by an outer peripheral face of the fuel guide member, has a diameter that is larger than that of the valve hole, and has inner ends of the fuel injection holes opening therein, the fuel guide member has formed in an outer peripheral portion a plurality of blocking portions partially blocking the valve hole and a plurality of cutouts that are present between these blocking portions and provide communication between the valve hole and the diffusion chamber, the plurality of fuel injection holes are divided into two groups disposed symmetrically relative to one diameter of the injector plate whereas the plurality of cutouts are divided into first cutouts corresponding to a region in which a plurality of the fuel injection holes in a middle section of each of the groups are arranged and second cutouts positioned on the diameter so as to face in opposite directions to each other, the fuel injection holes in the outside section of each of the groups are disposed so as to correspond to the respective blocking portions adjacent to the second cutouts, and the flow rate of fuel that comes from the second cutout, collides with an inner peripheral wall of the diffusion chamber, and is directed toward the fuel injection holes in the outside section is set higher than the flow rate of fuel that is directed from the first cutout toward the fuel injection holes in the outside section.

According to a fifteenth aspect of the present invention, in addition to the fourteenth aspect, the fuel injection holes in the outside section are provided so that one thereof corresponds to each of the blocking portions.

According to a sixteenth aspect of the present invention, in addition to the fifteenth aspect, the distance from the first cutout to the fuel injection hole in the outside section and the distance from the second cutout to the fuel injection hole in the outside section are set so as to be substantially equal.

According to a seventeenth aspect of the present invention, in addition to any one of the fourteenth to sixteenth aspects, the plurality of fuel injection holes are disposed on the same imaginary circle around an axis of the valve seat member.

According to an eighteenth aspect of the present invention, in addition to any one of the fourteenth to sixteenth aspects, the plurality of fuel injection holes are distributed on a plurality of concentric imaginary circles around an axis of the valve seat member.

According to a nineteenth aspect of the present invention, in addition to any one of the fourteenth to eighteenth aspects, the fuel injection holes in the outside section are disposed closer to an inner peripheral wall of the diffusion chamber than the midpoint between an outer peripheral face of the blocking portion and the inner peripheral wall.

EFFECTS OF THE INVENTION

In accordance with the first aspect of the present invention, the fuel passage extending from the valve seat to the fuel injection hole can be made short and to have a small dead volume, thereby suppressing pressure loss of the fuel effectively and enabling fuel that has passed through the valve seat to be injected quickly via each fuel injection hole, and as a result the atomization of injected fuel and the penetrability can be improved, thus greatly contributing to a reduction in the engine fuel consumption and a reduction in pollution by exhaust gas. Furthermore, making the dead volume of the fuel passage small is effective in stabilizing the fuel injection characteristics against changes in temperature. Moreover, the arrangement of the plurality of fuel passages in the valve hole enables the flow of fuel in the diffusion chamber to be controlled, and the direction of fuel injected from each fuel injection hole to be freely controlled.

Furthermore, in accordance with the second aspect of the present invention, since the outer peripheral wall of the annular diffusion chamber is formed from the valve seat member, the inner peripheral wall thereof is formed from the fuel guide member, which is connected to the injector plate so as to face the valve hole, and the plurality of fuel passages are formed in this fuel guide member, it is possible to form the plurality of fuel passages simply, thus making production easy.

Moreover, in accordance with the third aspect of the present invention, the fuel passages are formed from the cutouts provided in the outer periphery of the fuel guide member, and it is therefore possible to carry out formation of the fuel passages in a more simple manner.

Furthermore, in accordance with the fourth aspect of the present invention, due to the simple structure with which the valve seat and the fuel passages are arranged, in which an extension of the generatrix of the conical valve seat intersects the inner face of the fuel passage, fuel that has passed through the valve seat can be made to collide directly with the inner face of the fuel passage of the fuel guide member, the flow of fuel can forcibly be reversed quickly toward the diffusion chamber side, and the fuel can be injected quickly from the fuel injection hole while suppressing pressure loss, thus contributing to atomization of the injected fuel and improvement in the penetrability.

Moreover, in accordance with the fifth aspect of the present invention, by making $1<D1/D2\leqq 1.5$, the distance between the valve seat and the fuel injection holes can be minimized, and the pressure loss of fuel in this section can be suppressed effectively, thus contributing to atomization of the injected fuel and improvement in the penetrability.

Furthermore, in accordance with the sixth aspect of the present invention, since the fuel guide member is inserted into the valve hole, the dead volume of the valve hole can be decreased by the fuel guide member, the pressure loss of fuel passing through can be further reduced, and the fuel injection characteristics can be stabilized against changes in temperature.

Moreover, in accordance with the seventh aspect of the present invention, by making $H2/H1 \geqq 1.5$, the main stream of fuel that has passed through the valve seat can more reliably be made to collide with the inner face of the cutout of the fuel guide member, the flow of fuel can forcibly be reversed quickly toward the diffusion chamber side, and fuel can be injected quickly via the fuel injection hole, thus contributing to atomization of the injected fuel and improvement in the penetrability.

Furthermore, in accordance with the eighth aspect of the present invention, since the end face of the fuel guide member facing the valve hole is formed so as to follow the end face of the valve body facing the valve hole, the dead volume of the valve hole can be reduced effectively by the fuel guide member, the pressure loss of fuel passing through can be further reduced, and the fuel injection characteristics can further be stabilized against changes in temperature.

Moreover, in accordance with the ninth aspect of the present invention, the fuel guide member can be produced simply, and the fuel guide member can easily be welded to the injector plate while avoiding thermal deformation of the fuel guide member, thus stabilizing the fuel guiding properties of the fuel guide member and reducing the cost.

In accordance with the tenth aspect of the present invention, the fuel guide member facing the valve hole is connected to the injector plate, the annular diffusion chamber is formed between the valve seat member and the injector plate, is faced by the outer peripheral face of the fuel guide member, has a larger diameter than that of the valve hole, and has the inner ends of the fuel injection holes opening therein, the fuel guide member has formed in the outer peripheral portion the plurality of blocking portions partially blocking the valve hole and the plurality of cutouts that are between the blocking portions and provide communication between the valve hole and the diffusion chamber, and it is therefore possible to make the fuel passage extending from the valve seat to the fuel injection hole short and have a small dead volume, thereby suppressing pressure loss of the fuel effectively and enabling fuel that has passed through the valve seat to be injected quickly via each fuel injection hole, and as a result the injected fuel is atomized and the penetrability is improved, thus greatly contributing to a reduction in the engine fuel consumption and a reduction in pollution by exhaust gas. Making the dead volume of the fuel passage small is also effective in stabilizing the fuel injection characteristics against changes in temperature. Moreover, the arrangement of the plurality of fuel passages in the valve hole enables the flow of fuel in the diffusion chamber to be controlled, and the direction of fuel injected from each fuel injection hole to be freely controlled.

In particular, since the plurality of cutouts are arranged so as to circumscribe an imaginary circle having the center thereof on the axis of the valve seat member, the main stream of fuel that has passed through the valve seat can be made to collide evenly with the inner face of each cutout, the main stream can forcibly be reversed quickly toward the diffusion chamber side, and fuel can be injected quickly from the fuel injection holes while suppressing pressure loss, thus contributing to atomization of the injected fuel and an improvement in the penetrability.

Furthermore, in accordance with the eleventh aspect of the present invention, a relatively large amount of fuel is reversed at the inner face of the first cutout, directed radially outward of the diffusion chamber, and injected via the plurality of fuel injection holes in the middle section of each of the groups, and the injection directions thereof are slightly inclined toward the radial direction due to the influence of the fuel being reversed in the first cutout. On the other hand, a relatively small amount of fuel is reversed at the inner face of the second cutout, is directed radially outward of the diffusion chamber, divided into two by the inner peripheral face of the diffusion chamber, and injected via the fuel injection hole in the outside section of each of the groups, and the injection direction thereof is inclined in a direction that is substantially perpendicular to the diameter passing between the two groups of fuel injection holes due to the influence of guiding by the inner peripheral face of the diffusion chamber. As a result, the fuel injected from the two groups of fuel injection holes is separated into two and forms a pair of substantially conical fuel spray forms.

Moreover, in accordance with the twelfth aspect of the present invention, by making $(S1+S2)>S3$, the diffusion chamber from the valve-opening gap between the valve seat and the valve body to the fuel injection holes is not constricted, and it is therefore possible to suppress pressure loss of the fuel in the diffusion chamber effectively. Furthermore, in each fuel injection hole, due to the orifice effect the flow rate of injected fuel can be increased effectively, thus promoting the atomization of injected fuel effectively.

Furthermore, in accordance with the thirteenth aspect of the present invention, when setting the cutout width for the first cutout and the second cutout, by setting the cutout width of the first cutout larger than the cutout width of the second cutout so as to correspond to the number of fuel injection holes in the middle section of each of the groups, the fuel flow rates in the first cutout and the second cutout can be made to correspond to the number of fuel injection holes in the middle section of each of the groups and the number of fuel injection holes in the outside sections, and it is therefore possible to equalize the fuel injected from the fuel injection holes and give a good fuel spray form.

In accordance with the fourteenth aspect of the present invention, the fuel guide member facing the valve hole is connected to the injector plate, the annular diffusion chamber is formed between the valve seat member and the injector plate, is faced by the outer peripheral face of the fuel guide member, has a larger diameter than that of the valve hole, and has the inner ends of the fuel injection holes opening therein, the fuel guide member has formed in the outer peripheral portion the plurality of blocking portions partially blocking the valve hole and the plurality of cutouts that are between the blocking portions and provide communication between the valve hole and the diffusion chamber, and it is therefore possible to make the fuel passage extending from the valve seat to the fuel injection hole short and have a small dead volume, thereby suppressing pressure loss of the fuel effectively and enabling fuel that has passed through the valve seat to be injected quickly via each fuel injection hole, and as a result the injected fuel is atomized and the penetrability is improved, thus greatly contributing to a reduction in the engine fuel consumption and a reduction in pollution by exhaust gas. Making the dead volume of the fuel passage small is also effective in stabilizing the fuel injection characteristics against changes in temperature. Moreover, the arrangement of the plurality of fuel passages in the valve hole enables the flow of fuel in the diffusion chamber to be controlled, and the direction of fuel injected from each fuel injection hole to be freely controlled.

Furthermore, by dividing the plurality of fuel injection holes into two groups disposed symmetrically relative to one diameter of the injector plate while dividing the plurality of cutouts into first cutouts corresponding to a region with the plurality of fuel injection holes in the middle section of each of the groups and second cutouts positioned on the diameter and facing in directions opposite to each other, and disposing the fuel injection holes in the outside section of each of the groups so as to correspond to the blocking portions adjacent to the second cutouts, it is possible to form two symmetrical collective fuel spray forms by fuel injected from the two groups of fuel injection holes.

Moreover, since the flow rate of fuel that comes from the second cutout, collides with the inner peripheral wall of the diffusion chamber, and is directed toward the fuel injection holes in the outside section is set higher than the flow rate of fuel that is directed from the first cutout toward the fuel injection holes in the outside section, the large amount of fuel that is directed from the second cutout toward the fuel injection holes in the outside section along the inner peripheral wall of the diffusion chamber convolves the fuel that is directed from the first cutout toward the fuel injection holes in the outside section, and is injected from the fuel injection holes in the outside section while generating a swirl, and this swirl can promote the atomization of injected fuel effectively.

Furthermore, in accordance with the fifteenth aspect of the present invention, the large amount of fuel that is directed from the second cutout toward the fuel injection holes in the outside section along the inner peripheral wall of the diffusion chamber convolves effectively the fuel that is directed from the first cutout toward the fuel injection holes in the outside section around one fuel injection hole in the outside section, and is injected from the fuel injection holes in the outside section while generating a strong swirl, thereby promoting the atomization of injected fuel more effectively.

Moreover, in accordance with the sixteenth aspect of the present invention, fuel that is directed from the second cutout toward the fuel injection hole in the outside section along the inner peripheral wall of the diffusion chamber, and fuel that is directed from the first cutout toward the fuel injection hole in the outside section reach an area around the fuel injection hole in the outside section after advancing substantially equal distances, thereby generating a swirl effectively by these flows of fuel, and promoting the atomization of injected fuel further effectively.

Furthermore, in accordance with the seventeenth aspect of the present invention, the gaps between the plurality of fuel injection holes can be set freely on the same imaginary circle around the axis of the valve seat member, and as a result it is possible to avoid interference between fuel spray forms formed by fuel injected from each fuel injection hole, thus forming a collective fuel spray form having high penetrability.

Moreover, in accordance with the eighteenth aspect of the present invention, distributing the plurality of fuel injection holes on the plurality of concentric imaginary circles around the axis of the valve seat member enables the plurality of fuel injection holes to be sufficiently spaced apart, thus avoiding interference between the fuel spray forms formed by fuel injected from each fuel injection hole.

Furthermore, in accordance with the nineteenth aspect of the present invention, the fuel injection holes in the outside section are in proximity to the flow of fuel that comes from the second cutout, collides with the inner peripheral wall of the diffusion chamber, and flows along the inner peripheral wall, and injection of fuel that has formed a swirl can be carried out effectively, thus further promoting the atomization of injected fuel.

EXPLANATION OF REFERENCE NUMERALS AND SYMBOLS

Figure 1:
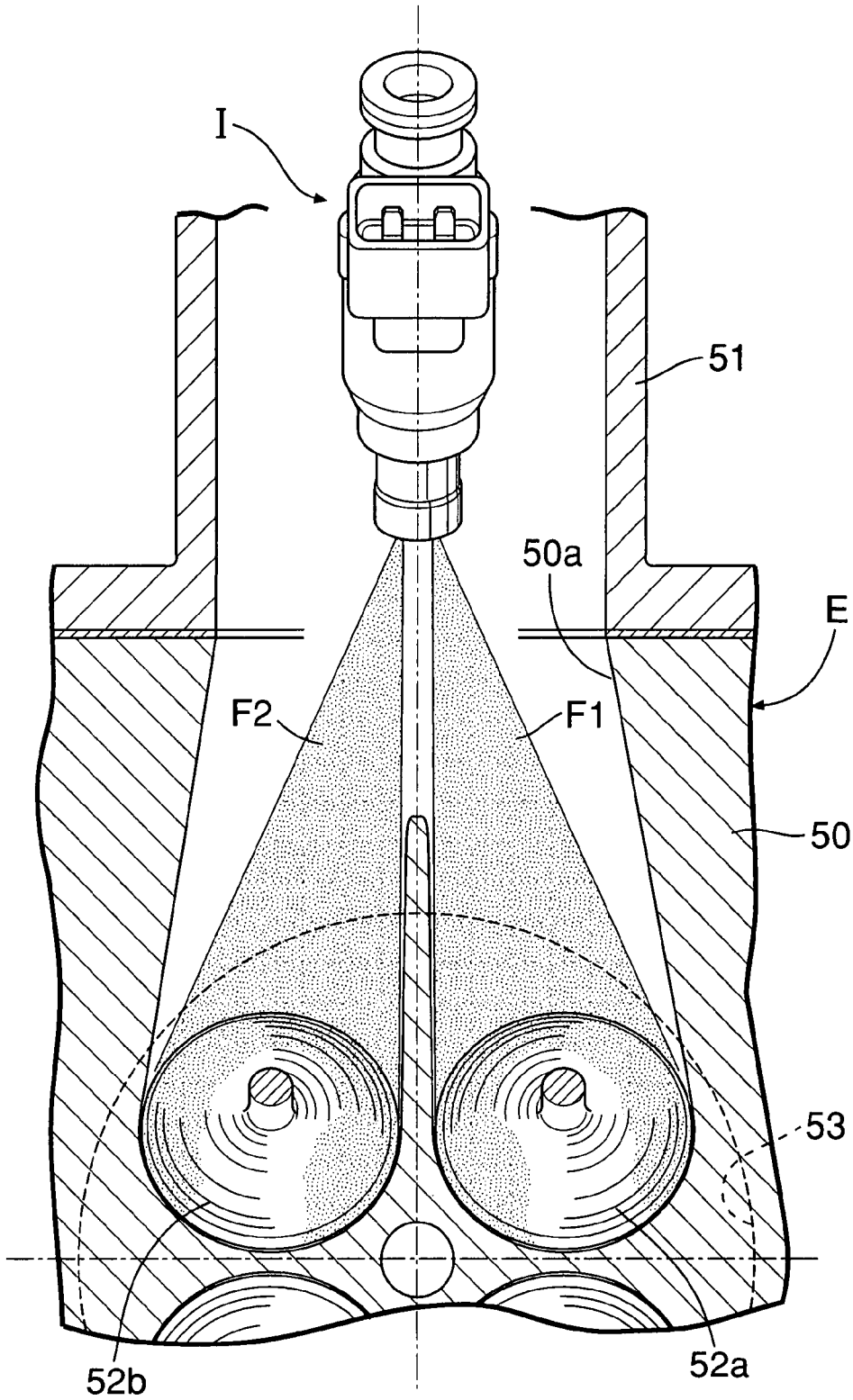
FIG. 1 is a plan view showing a state in which an electromagnetic fuel injection valve related to a first embodiment of the present invention is used in an engine (first embodiment).

G1, G2 Groups of fuel injection holes
I Fuel injection valve
L Extension of generatrix of valve seat
R Diameter partitioning groups G1 and G2 of fuel injection holes
Y Axis of valve seat member
3 Valve seat member
7 Valve hole
8 Valve seat
13
10 Injector plate
11 Fuel injection hole
11(A) Middle section fuel injection hole
11(B) Outside section fuel injection hole
16*a* End face of valve body
18 Valve body
39 Diffusion chamber
40 Fuel guide member
40*a* End face of fuel guide member
41 Blocking portion of fuel guide member
42*a*, 42*a* Fuel passage (cutout)

BEST MODE FOR CARRYING OUT THE INVENTION

Modes for carrying out the present invention are explained below by reference to preferred embodiments of the present invention shown in the attached drawings.

Embodiment 1

An explanation now starts from a first embodiment of the present invention shown in FIG. 1 to FIG. 7.

In FIG. 1, formed in a cylinder head 50 of an engine E are a combustion chamber 53 and an intake port 50*a* having the downstream end opening in the combustion chamber 53. This intake port 50*a* is bifurcated on the downstream side and opens in the combustion chamber 53, and this pair of openings are opened and closed by a pair of intake valves 52*a* and 52*b*. Joined to one side of the cylinder head 50 is an intake manifold 51 having its interior communicating with the upstream end of the intake port 50*a*, and mounted on the intake manifold 51 is an electromagnetic fuel injection valve I of the present invention for supplying a pair of fuel spray forms F1 and F2 toward the bifurcated downstream end of the intake port 50*a* when the intake valves 52*a* and 52*b* are opened.

Figure 2:
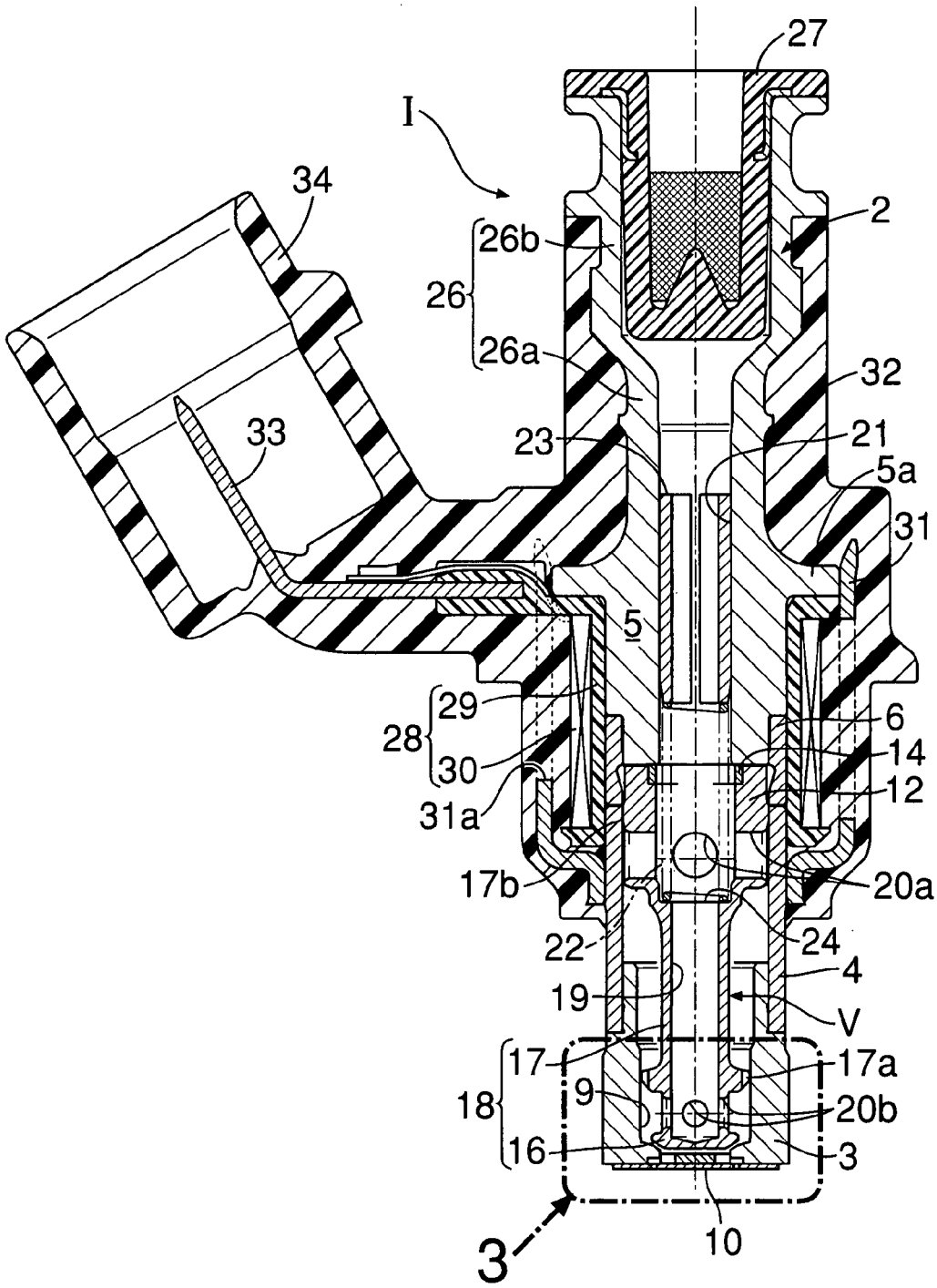
FIG. 2 is a vertical sectional view of the fuel injection valve (first embodiment).
Figure 3:
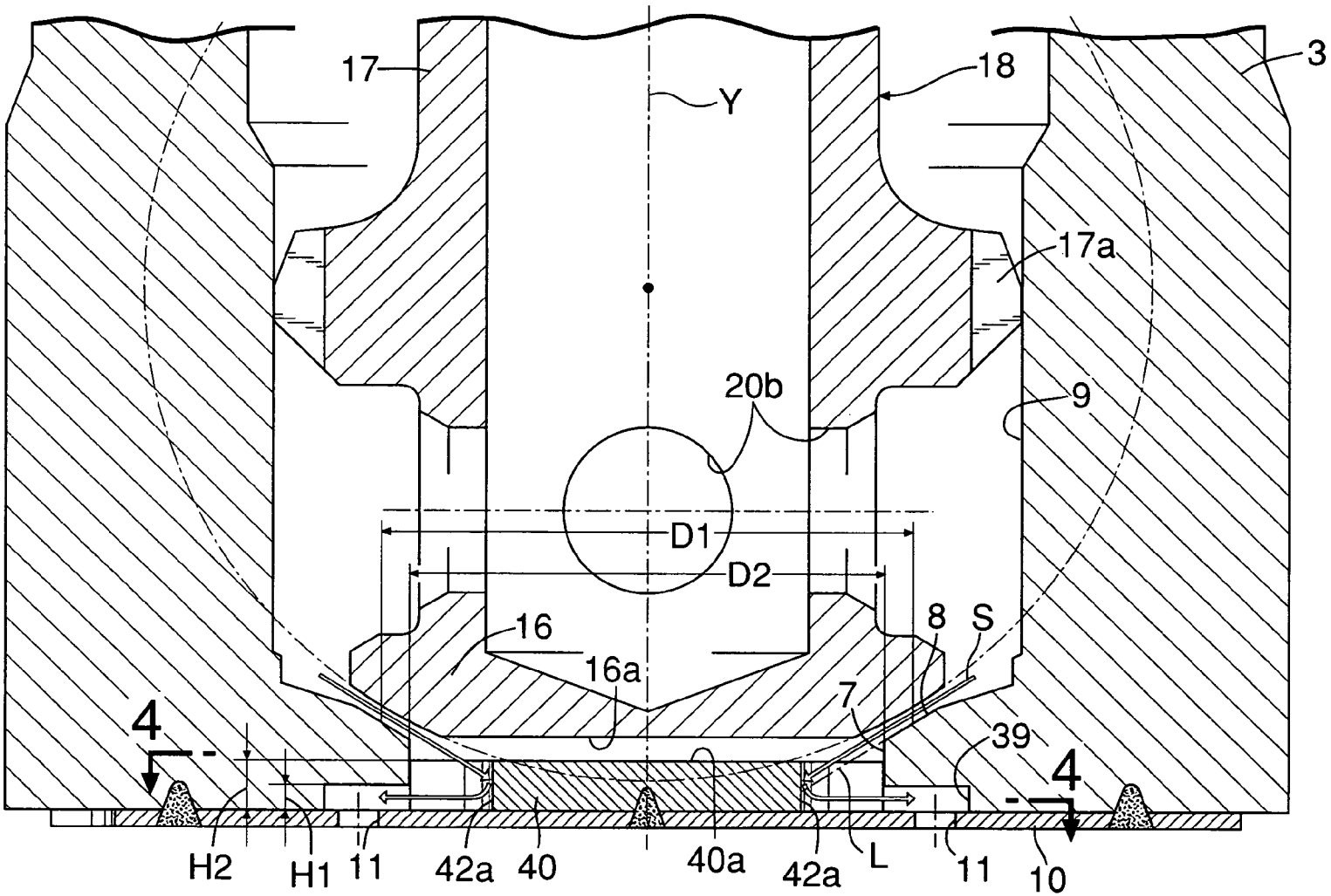
FIG. 3 is an enlarged view of part 3 in FIG. 2 (first embodiment).

In FIG. 2 and FIG. 3, a valve housing 2 of the fuel injection valve I is formed from a cylindrical valve seat member 3 having a valve seat 8 at the front end, a magnetic cylindrical body 4 joined coaxially in a liquid-tight manner to a rear end part of the valve seat member 3, a non-magnetic cylindrical body 6 joined coaxially in a liquid-tight manner to the rear end of the magnetic cylindrical body 4, a fixed core 5 joined coaxially in a liquid-tight manner to the rear end of the non-magnetic cylindrical body 6, and a fuel inlet tube 26 connected coaxially to the rear end of the fixed core 5.

The valve seat member 3 has a cylindrical guide hole 9, the conical valve seat 8, which is connected to the front end of the guide hole 9, and a valve hole 7 running through a central section of the valve seat 8.

The hollow cylindrical fixed core 5 is press-fitted in a liquid-tight manner into an inner peripheral face of the non-magnetic cylindrical body 6 from the rear end, thereby joining the non-magnetic cylindrical body 6 and the fixed core 5 coaxially to each other. In this arrangement, there is a portion remaining at the front end of the non-magnetic cylindrical body 6 into which the fixed core 5 is not fitted, and a valve assembly V is housed within the valve housing 2 from that portion to the valve seat member 3.

The valve assembly V includes a valve body 18 formed from a valve portion 16 for opening and closing the valve seat 8 and a valve stem portion 17 supporting the valve portion 16, and a movable core 12 that is connected to the valve stem portion 17, is inserted into the magnetic cylindrical body 4 and the non-magnetic cylindrical body 6 so as to straddle them, and coaxially faces the fixed core 5. The valve stem portion 17 is formed so as to have a smaller diameter than that of the guide hole 9, and has integrally formed on its outer periphery a radial projecting journal portion 17*a* that is slidably supported on an inner peripheral face of the guide hole 9. Furthermore, a journal portion 17*b* is formed on the outer periphery to the movable core 12, the journal portion 17*b* being slidably supported on an inner peripheral face of the magnetic cylindrical body 4.

The valve assembly V is provided with a lengthwise hole 19 extending from the rear end face of the movable core 12 up to just before the valve portion 16, a plurality of first lateral holes 20*a* providing communication between the lengthwise hole 19 and an outer peripheral face of the movable core 12, and a plurality of second lateral holes 20*b* providing communication between the lengthwise hole 19 and an outer peripheral face of the valve stem portion 17 between the journal portion 17*a* and the valve portion 16. In this arrangement, an annular spring seat 24 facing the fixed core 5 side is formed partway along the lengthwise hole 19.

The fixed core 5 is made of a ferrite-based high hardness magnetic material. On the other hand, a collar-shaped high hardness stopper element 14 surrounding the valve spring 22 is embedded in an attracting face of the movable core 12 that faces an attracting face of the fixed core 5. This stopper element 14 has its outer end projecting slightly from the attracting face of the movable core 12, and is normally disposed opposite the attracting face of the fixed core 5 across a gap corresponding to a valve opening stroke of the valve body 18.

The fixed core 5 has a lengthwise hole 21 communicating with the lengthwise hole 19 of the valve assembly V, and the fuel inlet tube 26 is integrally connected to the rear end of the fixed core 5, the interior of the fuel inlet tube 26 communicating with the lengthwise hole 21. The fuel inlet tube 26 is formed from a decreased diameter portion 26*a* connected to the rear end of the fixed core 5 and, continuing therefrom, an increased diameter portion 26*b*, and the valve spring 22 is provided in a compressed state between the spring seat 24 and a slotted pipe-shaped retainer 23 press-fitted into the lengthwise hole 21 from the decreased diameter portion 26*a*, the valve spring 22 urging the movable core 12 in a valve-closing direction of the valve body 18. In this arrangement, a set load of the valve spring 22 is adjusted by the depth to which the retainer 23 is fitted into the lengthwise hole 21. A fuel filter 27 is mounted within the increased diameter portion 26*b*.

A coil assembly 28 is fitted around the outer periphery of the valve housing 2 so as to correspond to the fixed core 5 and the movable core 12. This coil assembly 28 is formed from a bobbin 29 fitted around outer peripheral faces from the rear end part of the magnetic cylindrical body 4 to the fixed core 5, and a coil 30 wound around the bobbin 29; the front end of a coil housing 31 surrounding the coil assembly 28 is welded to an outer peripheral face of the magnetic cylindrical body 4, and the rear end thereof is welded to an outer peripheral face of a yoke 5*a* projecting from the outer periphery of a rear end part of the fixed core 5 in a flange shape. The coil housing 31 has a cylindrical shape and has an axially extending slit 31*a* formed in one side thereof.

A portion of the magnetic cylindrical body 4, the coil housing 31, the coil assembly 28, the fixed core 5, and the front half of the fuel inlet tube 26 are sealed by injection molding in a cylindrical molding portion 32 made of a synthetic resin. In this arrangement, the interior of the coil housing 31 is filled with the molding portion 32 via the slit 31*a*. A coupler 34 projecting toward one side is formed integrally with a middle section of the molding portion 32, and this coupler 34 retains an energizing terminal 33 connected to the coil 30.

An injector plate 10 has its outer peripheral portion laser-welded to a front end face of the valve seat member 3 in a liquid-tight manner, and an annular diffusion chamber 39 having a larger diameter than that of the valve hole 7 is formed between opposing faces of the injector plate 10 and the valve seat member 3. The outer peripheral wall of the annular diffusion chamber 39 is formed from the valve seat member 3, and the inner peripheral wall thereof is formed from a fuel guide member 40 joined to an inner face of the injector plate 10 and inserted into the valve hole 7.

A plurality of fuel injection holes 11 are bored in the injector plate 10, the fuel injection holes 11 opening in the diffusion chamber 39. As is clearly shown in FIG. 3 and FIG. 4, these fuel injection holes 11 are formed so as to be parallel to an axis Y of the valve seat member 3 and are arranged on an imaginary circle C1 having its center on the axis Y. In this arrangement, these fuel injection holes 11 are divided into two groups G1 and G2 arranged symmetrically relative to one diameter R of the imaginary circle C1. In each of the groups G1 and G2, a plurality (three in the illustrated example) of fuel injection holes 11(A) are disposed at equal intervals in a middle section thereof, and a pair of fuel injection holes 11(B) are disposed at a distance that is larger than the above interval on opposite outer sides of the fuel injection holes 11(A).

Figure 4:
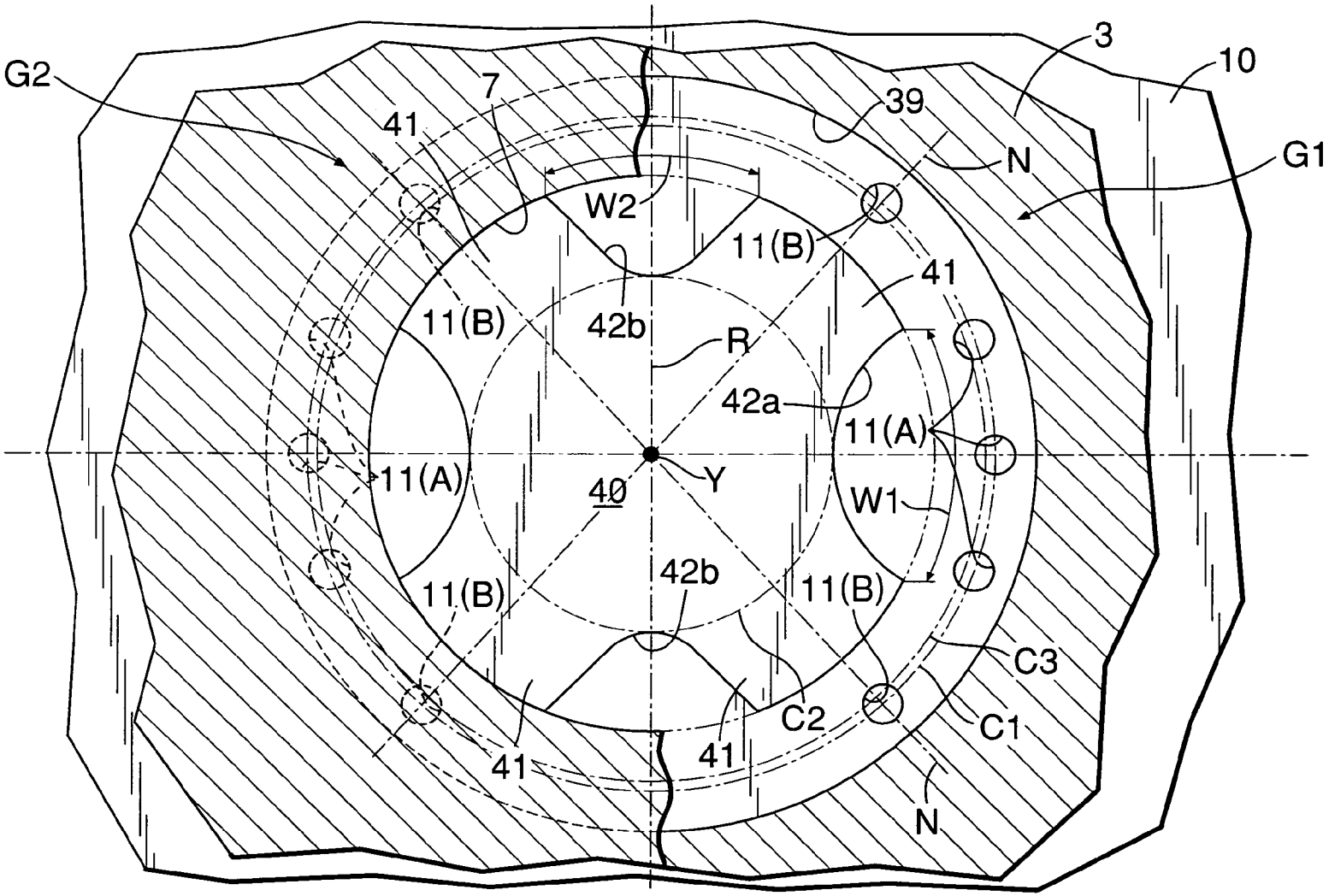
FIG. 4 is a sectional view along line 4-4 in FIG. 3 (first embodiment).
Figure 5:
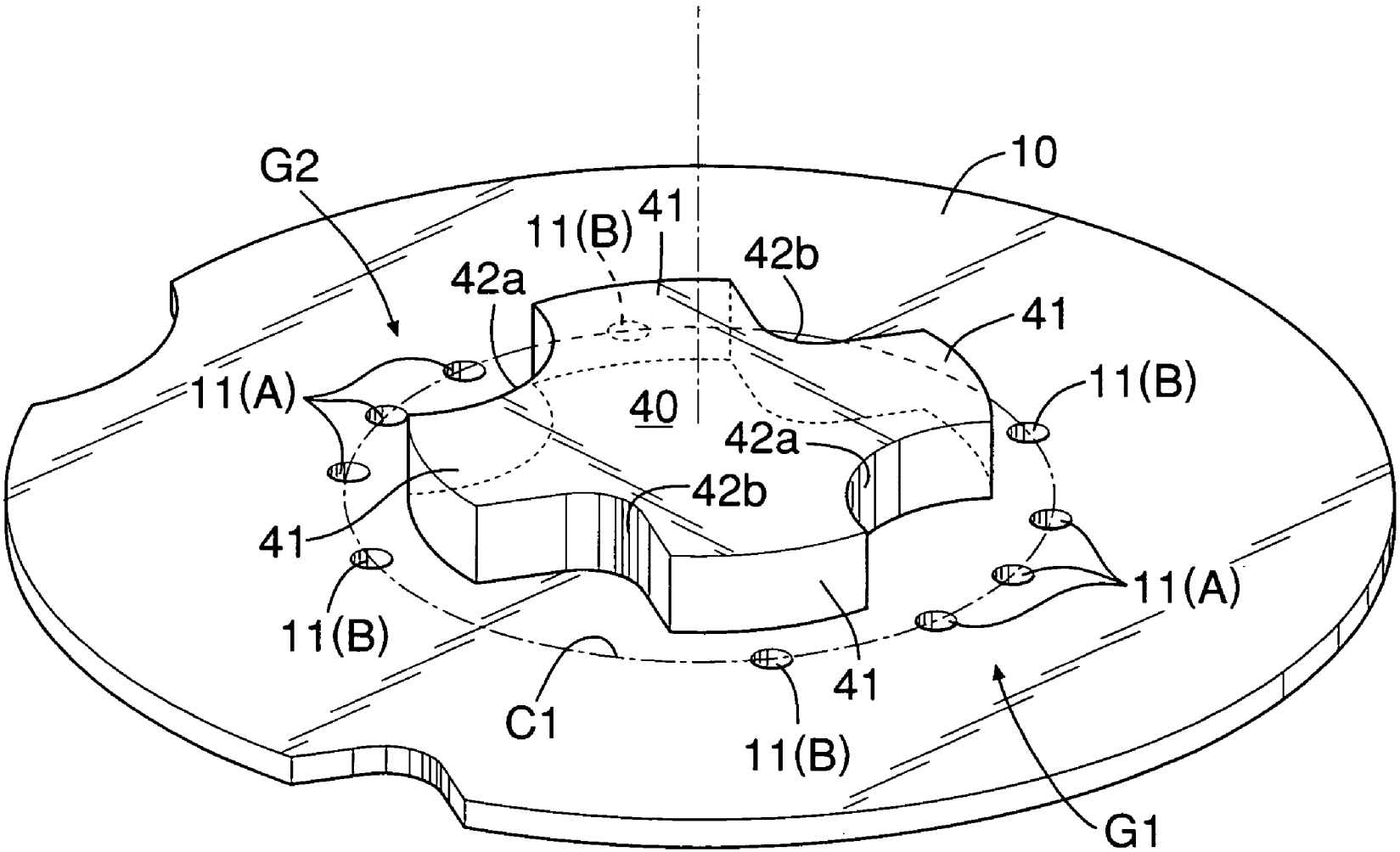
FIG. 5 is a perspective view showing a state in which a fuel guide member is joined to an injector plate in the fuel injection valve (first embodiment).

As shown in FIG. 3 to FIG. 5, the fuel guide member 40 is basically a disk, and includes on its outer periphery a plurality of blocking portions 41 fitted into an inner peripheral face of the valve hole 7 and partially blocking the valve hole 7, and a plurality of cutouts 42*a* and 42*b* disposed between the blocking portions 41 and providing communication between the valve hole 7 and the diffusion chamber 39.

Since if the positions of the cutouts 42*a* and 42*b* are determined the positions of the blocking portions 41 therebetween are naturally determined, the positions of the cutouts 42*a* and 42*b* are explained.

One first cutout 42*a* having a large cutout area S1 is positioned so as to correspond to a region of the middle section of each of the groups G1 and G2 in which the three fuel injection holes 11(A) are disposed, and a pair of second cutouts 42*b* having a small cutout area S2 are disposed so as to face in opposite directions to each other along the diameter R. The fuel injection holes 11(B) in the outside sections of each of the groups G1 and G2 are disposed so as to face the blocking portions 41 adjacent to the second cutouts 42*b*.

The cutouts 42*a* and 42*b* are disposed so as to circumscribe an imaginary circle C2 having its center on the axis of the valve seat member 3, and an extension L of the generatrix of the conical valve seat 8 intersects an inner face of each of the cutouts 42*a* and 42*b*.

Furthermore, a cutout width W1 of the first cutout 42*a* along the inner peripheral face of the valve hole 7 is set larger than a cutout width W2 of the second cutout 42*b* along the inner peripheral face of the valve hole 7, and the aperture area S1 of the first cutout 42*a* is thereby set larger than the aperture area S2 of the second cutout 42*b*.

The fuel guide member 40 is fitted into the valve hole 7 as deeply as possible in order to minimize the dead volume within the valve hole 7 but so that it does not interfere with the front end face of the valve body 18, and opposing faces 16*a* and 40*a* of the valve body 18 and the injector plate 10 are formed as flat faces that are parallel to each other.

The fuel guide member 40 is produced by press forming a thin steel plate, and is joined to the injector plate 10 by spot-welding by means of a laser from the outer face side thereof.

All of the fuel injection holes 11(A) and 11(B) arranged on the imaginary circle C1 are disposed closer to the inner peripheral wall of the diffusion chamber 39 than the midpoint between an outer peripheral face of the blocking portion 41 of the fuel guide member 40 and the inner peripheral wall. In other words, the imaginary circle C1 has a larger diameter than that of a coaxial imaginary circle C3 formed through the midpoint.

The fuel injection holes 11(B) in the outside sections of each of the groups G1 and G2 are disposed on bisectors N of the blocking portions 41 formed through the axis Y. Because of this, the distance from the first cutout 42*a* to the fuel injection hole 11(B) in the outside section and the distance from the second cutout 42*b* to the fuel injection hole 11(B) in the outside section are set so as to be equal.

When the cutout width of the cutout 42*a* along the inner peripheral face of the valve hole 7 is W1, and the cutout width of the second cutout 42*b* along the inner peripheral face of the valve hole 7 is W2, they are set so that the following formula holds.

$$W1:W2,z\approx 3:2 \quad (1)$$

When the aperture area of the first cutout 42*a* is S1, the aperture area of the second cutout 42*b* is S2, the valve-opening area between the valve seat 8 and the valve body 18 is S3, the total aperture area of all of the fuel injection holes 11 of the first and second groups is S4, the effective diameter of the valve seat 8 is D1, and the valve opening stroke of the valve body 18 is t, they are set so that the following formulae hold.

$$(S1+S2)>S3>S4 \quad (2)$$

$$S3=D1\times t \quad (3)$$

When the effective diameter of the valve seat 8 is D1, and the diameter of the valve hole 7 is D2, they are set so that following formula holds.

$$1<DVD2\ 5\ 1.5 \quad (4)$$

When the height of the diffusion chamber 39 is H1, and the thickness of the fuel guide member 40 is H2, they are set so that the following formula holds.

$$1-12/1-11\geqq_1.5 \quad (5)$$

The operation of the first embodiment is now explained.

In a state in which the coil 30 is de-energized, the valve assembly V is pushed forward by means of an urging force of the valve spring 22, thus seating the valve body 18 on the valve seat 8. In this state, fuel that has been pumped from a fuel pump (not illustrated) to the fuel inlet tube 26 flows through the interior of the pipe-shaped retainer 23, the lengthwise hole 19 of the valve assembly V, and the first and second lateral holes 20*a* and 20*b*, is held in readiness within the valve seat member 3, and is supplied for lubrication around the journal portions 17*a* and 17*b* of the valve assembly V.

When the coil 30 is energized by the passage of current, the magnetic flux generated thereby runs, in sequence, through the fixed core 5, the coil housing 31, the magnetic cylindrical body 4, and the movable core 12, and due to the magnetic force thereof the movable core 12 of the valve assembly V is attracted to the fixed core 5 against the set load of the valve spring 22; as shown in FIG. 3, the valve portion 16 of the valve body 18 separates from the valve seat 8 of the valve seat member 3, and a main stream S of high pressure fuel within the valve seat member 3 advances toward the valve hole 7 side along the conical face of the valve seat 8.

Since the fuel guide member 40, which defines the diffusion chamber 39 having a larger diameter than that of the valve hole 7, is inserted into the valve hole 7, and the extension L of the generatrix of the conical valve seat 8 intersects the inner face of each of the plurality of cutouts 42*a* and 42*b* that are provided in the fuel guide member 40 and that provide communication between the valve hole 7 and the diffusion chamber 39, the main stream S of fuel that is directed toward the valve hole 7 along the valve seat 8 collides directly with the inner faces of the cutouts 42*a* and 42*b* of the fuel guide member 40, is forcibly reversed quickly toward the diffusion chamber 39 side, and is injected quickly from the fuel injection holes 11.

The fuel guide member 40 is involved in making the fuel passage, which as described above includes the valve hole 7 and the diffusion chamber 39, from the valve seat 8 to each fuel injection hole 11 short and have a small dead volume, thereby suppressing pressure loss in the fuel effectively and enabling fuel that has passed through the valve seat 8 to be injected quickly via the fuel injection holes 11. It is therefore possible to atomize fuel injected from these fuel injection holes 11 effectively and to form good fuel spray forms F1 and F2 having high penetrability.

Furthermore, as described above, making the fuel passage from the valve seat 8 to each fuel injection hole 11 have a small dead volume also contributes to stabilization of the fuel injection characteristics against changes in temperature.

The cutouts 42*a* and 42*b* are disposed so as to circumscribe the imaginary circle C2 having its center on the axis of the valve seat member 3, and it is therefore possible to make the conditions under which the fuel collides with the inner face of each of the cutouts 42*a* and 42*b* uniform.

Figure 6:
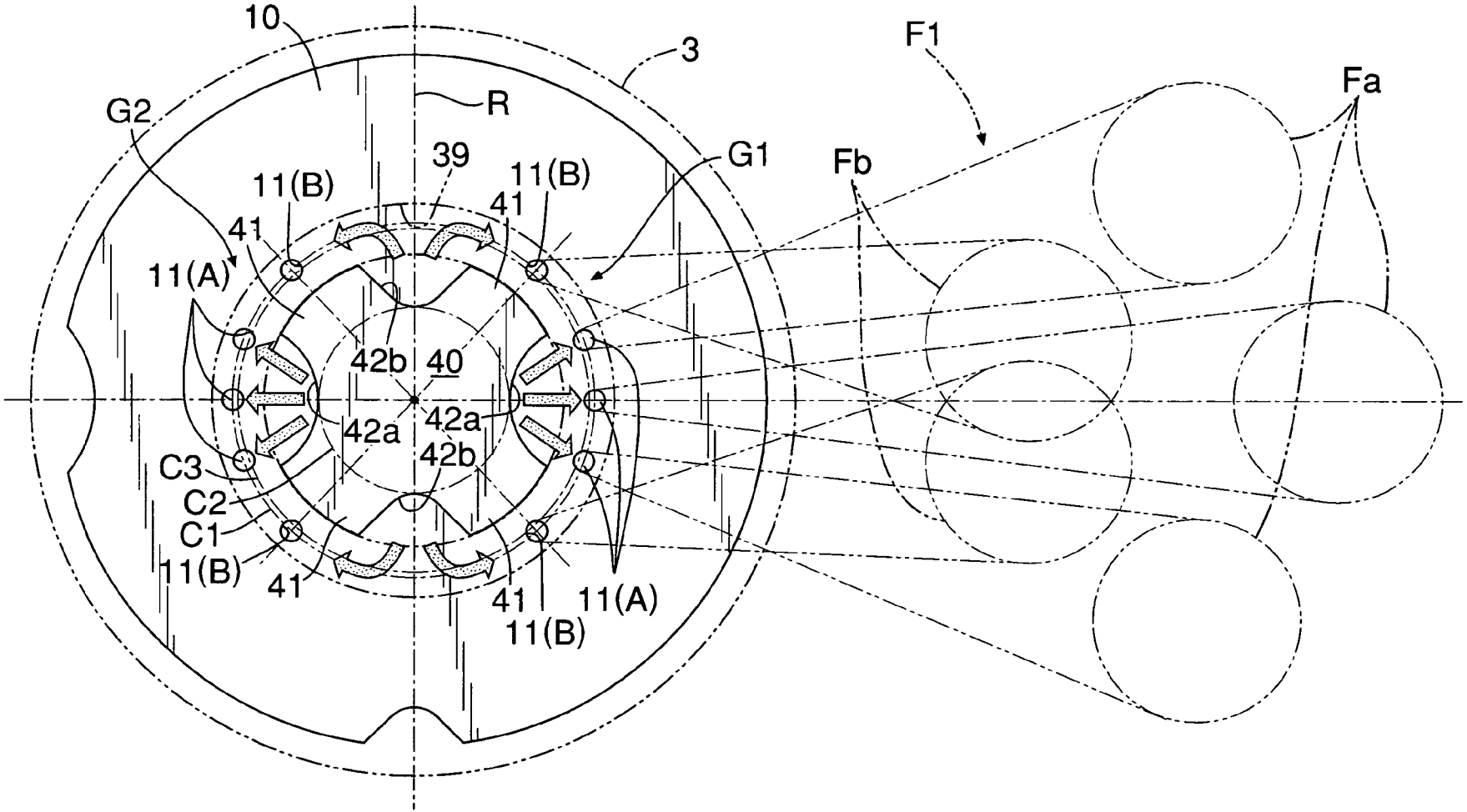
FIG. 6 is a diagram for explaining the formation of a fuel spray form by fuel injected from the fuel injection valve (first embodiment).

As shown in FIG. 6, fuel that has collided with the inner face of the first cutout 42*a* is reversed toward the diffusion chamber 39 side and injected via the fuel injection holes 11(A) in the middle section of each of the groups G1 and G2 in the injector plate 10, and the injection direction thereof is slightly inclined toward the radial direction due to the influence of the fuel being reversed in the first cutout 42*a*. On the other hand, after fuel that has collided with the inner face of the second cutout 42*b* has been reversed toward the diffusion chamber 39 side, the fuel is divided into two by means of the inner peripheral face of the diffusion chamber 39 and injected from the fuel injection hole 11(B) in the outside section of each of the groups G1 and G2, and the injection direction thereof is inclined in a direction substantially perpendicular to the diameter R running between the fuel injection holes 11; 11 of the two groups G1 and G2 due to the influence of the inner peripheral face of the diffusion chamber 39. As a result, fuel injected from the fuel injection holes 11 of each of the groups G1 and G2 forms a pair of substantially conical fuel spray forms F1 and F2, and these fuel spray forms F1 and F2 are supplied toward the bifurcated downstream end of the intake port 50*a*. Since these spray forms F1 and F2 have high penetrability, there is very little loss of fuel due to attachment to the inner wall of the intake port 50*a* of the engine E, thus greatly contributing to a reduction in the fuel consumption of the engine E and a reduction in pollution by exhaust gas.

Figure 7:
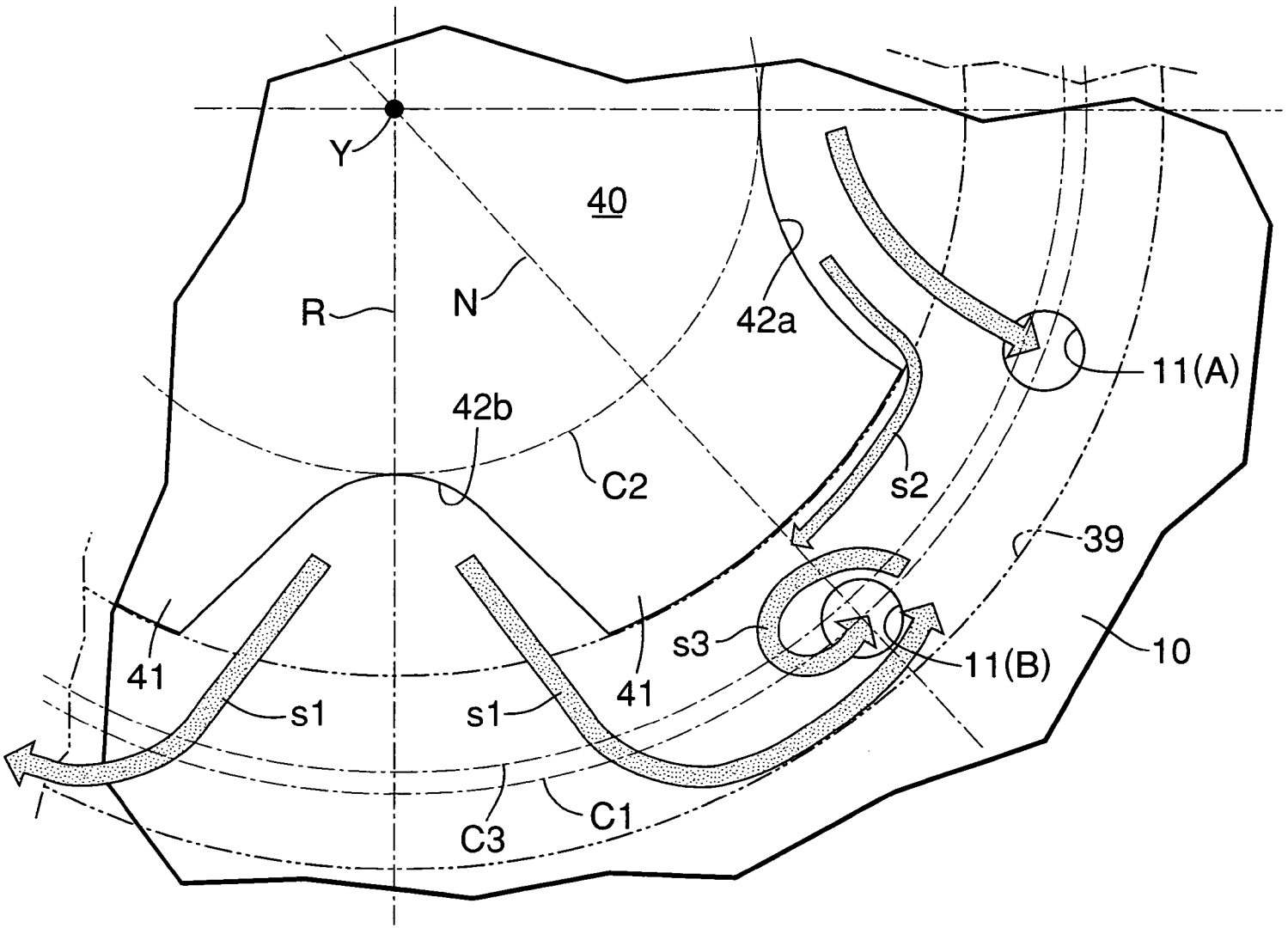
FIG. 7 is a diagram for explaining the generation of a swirl of fuel around a fuel injection hole in an outside section of FIG. 6 (first embodiment).

In particular, since much of the fuel that has passed through the first cutout 42*a* is injected immediately via the fuel injection holes 11(A) in the middle section, whereas fuel that has passed through the second cutout 42*b* collides with the inner peripheral wall of the diffusion chamber 39 and is divided to the left and right and each thereof is directed toward the fuel injection hole 11(B) in the outside section along the inner peripheral wall, the flow rate of fuel directed from the second cutout 42*b* toward the fuel injection hole 11(B) in the outside section is higher than the flow rate of fuel directed from the first cutout 42*a* toward the fuel injection hole 11(B) in the outside section, and as clearly shown in FIG. 7 due to this difference in flow rate, a flow s1 of a large amount of fuel directed from the second cutout 42*b* toward the fuel injection hole 11(B) in the outside section along the inner peripheral wall of the diffusion chamber 39 convolves a flow s2 of fuel directed from the first cutout 42*a* toward the fuel injection hole 11(B) in the outside section, thus generating a swirl s3 of fuel around the fuel injection hole 11(B) in the outside section. Therefore, fuel in a swirling state is injected from the fuel injection hole 11(B) in the outside section, thus promoting the atomization of injected fuel effectively.

In this arrangement, since the distance between the first cutout 42*a* and the fuel injection hole 11(B) in the outside section and the distance between the second cutout 42*b* and the fuel injection hole 11(B) in the outside section are set so as to be substantially equal, the flow of fuel directed from the second cutout 42*b* toward the fuel injection hole 11(B) in the outside section along the inner peripheral wall of the diffusion chamber 39 and the flow of fuel directed from the first cutout 42*a* toward the fuel injection hole 11(B) in the outside section advance over a substantial distance and reach an area around the fuel injection hole 11(B) in the outside section, and the swirl s3 is generated effectively by these flows s1 and s2 of fuel, thus contributing to promotion of the atomization of injected fuel.

Furthermore, since the fuel injection hole 11(B) in the outside section is disposed closer to the inner peripheral wall of the diffusion chamber 39 than the midpoint between the outer peripheral face of the blocking portion 41 of the fuel guide member 40 and the inner peripheral wall of the diffusion chamber 39, the fuel injection hole 11(B) in the outside section is in proximity to the flow of fuel coming from the second cutout 42*b*, colliding with the inner peripheral wall of the diffusion chamber 39, and flowing along the inner peripheral wall, thus enabling swirling injection of fuel to be carried out effectively and thereby contributing to promotion of the atomization of injected fuel.

Since all of the fuel injection holes 11 are disposed on the same imaginary circle C1 around the axis Y of the valve seat member 3, the gap between the fuel injection holes 11 can be set freely on the same imaginary circle C1, thus avoiding interference between fuel spray forms Fa formed by fuel injected from the fuel injection holes 11 and thereby forming collective fuel spray forms F1 and F2 having high penetrability.

As described above, by making (S1+S2)>S3>S4, the diffusion chamber 39 from the valve-opened gap between the valve seat 8 and the valve body 18 to the fuel injection holes 11 is not constricted, and it is therefore possible to suppress the pressure loss of fuel in the diffusion chamber 39 effectively. Furthermore, in each of the fuel injection holes 11, due to the orifice effect the velocity of flow of injected fuel can be increased effectively, and the atomization of injected fuel can be promoted effectively.

Furthermore, by making W1:W2≈3:2, the flow rates of fuel in the first cutout 42*a* and the second cutout 42*b* can be made to correspond to the number of fuel injection holes 11(A) in the middle section and the number of fuel injection holes 11(B) in the outside section of each of the groups G1 and G2, and it is therefore possible to equalize the fuel injected from the fuel injection holes 11(A) and 11(B) of each of the groups G1 and G2, thus forming good fuel spray forms F1 and F2.

Moreover, as described above, by making 1<D1/D2≦1.5, the distance between the valve seat 8 and the fuel injection holes 11 is minimized, thus suppressing the pressure loss of fuel therebetween effectively and thereby contributing to improvements in the atomization and penetrability of injected fuel.

Furthermore, as described above, by making H2/H1≧1.5, the main stream S of fuel that has passed through the valve seat 8 can be made to collide more reliably with the inner faces of the cutouts 42*a* and 42*b* of the fuel guide member, the flow of fuel can forcibly be reversed quickly toward the diffusion chamber 39 side, and the fuel can be injected quickly from the fuel injection holes 11, thus contributing to improvements in the atomization and penetrability of injected fuel.

Moreover, since the end face 40*a* of the fuel guide member 40 inserted into the valve hole 7 and the front end face 16*a* of the valve body 18 facing the valve hole 7 are made as flat faces parallel to each other, the dead volume of the valve hole can be reduced effectively by the fuel guide member 40, the pressure loss of fuel passing through can be further decreased, and the fuel injection characteristics can be stabilized against changes in temperature.

Furthermore, since the fuel guide member 40 is produced by press forming, and is joined to the injector plate 10 by spot-welding by means of a laser from the outer face side thereof, the fuel guide member 40 can be produced simply, it can easily be welded to the injector plate 10 while avoiding thermal deformation of the fuel guide member 40, the fuel guiding properties of the fuel guide member 40 can be stabilized, and the cost can be reduced.

Embodiment 2

Figure 8:
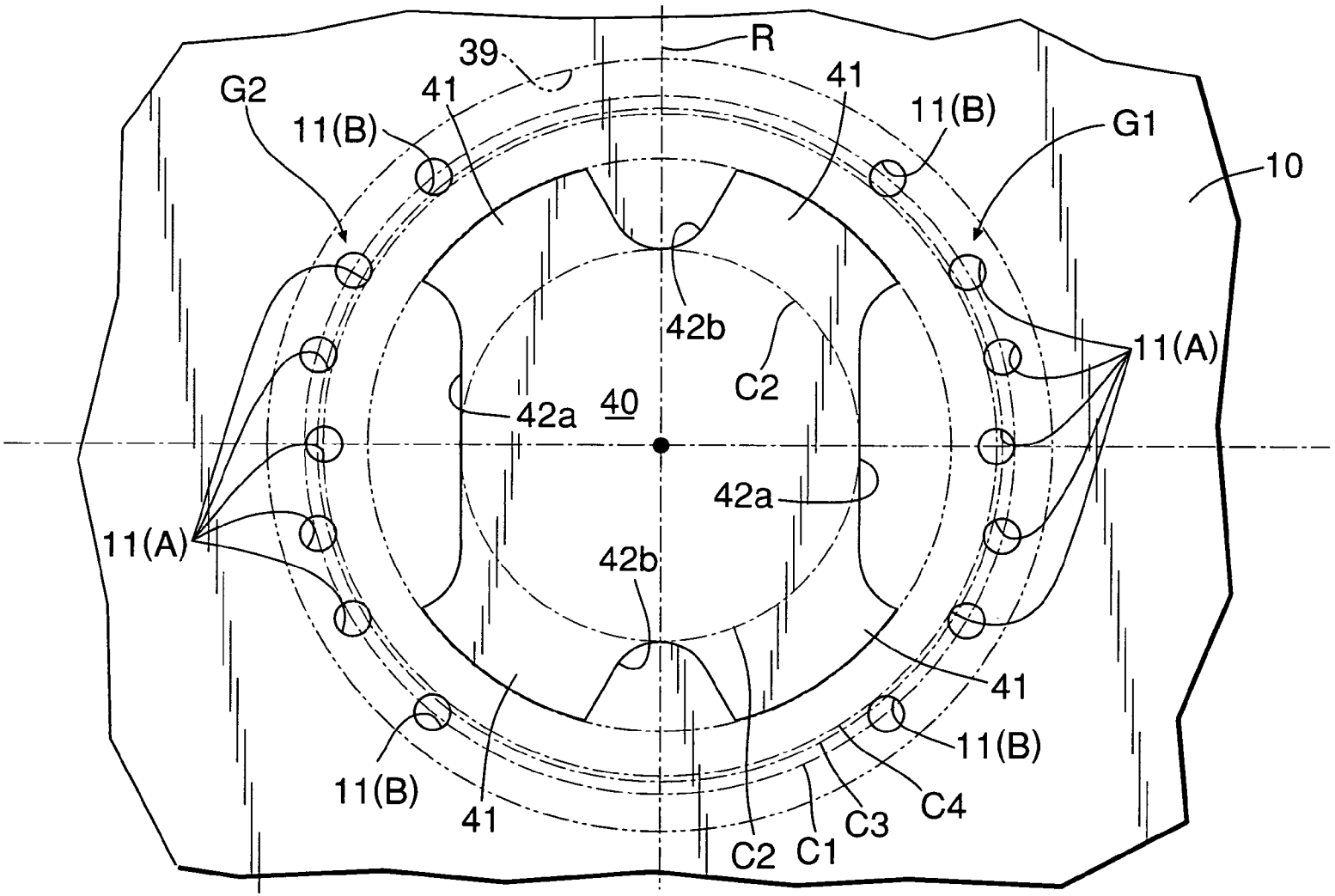
FIG. 8 is a view, corresponding to FIG. 4, showing a second embodiment of the present invention (second embodiment).

A second embodiment of the present invention shown in FIG. 8 is now explained.

In this second embodiment, with regard to fuel injection holes 11 of each of groups G1 and G2 of an injector plate 10, the number of a plurality of fuel injection holes 11(A) in a middle section is larger than that of the first embodiment in each group, and some fuel injection holes among the fuel injection holes 11(A) in the middle section are distributed on an imaginary circle C4 that is concentric with and has a smaller diameter than the above imaginary circle C1; apart from the above the arrangement of the second embodiment is substantially the same as that of the first embodiment, and in FIG. 8, portions corresponding to those of the first embodiment are denoted by the same reference numerals and symbols, thus avoiding duplication of the explanation.

In accordance with the second embodiment, distributing the plurality of fuel injection holes 11(A) of the middle section on the plurality of concentric imaginary circles C1 and C4 enables a sufficient gap between the plurality of fuel injection holes 11(A) to be guaranteed, thus avoiding interference between fuel spray forms Fa formed by fuel injected from the fuel injection holes 11(A).

Furthermore, with regard to the fuel injection holes 11 of each of the groups G1 and G2, since the number of fuel injection holes 11(A) in the middle section is increased and the cutout width of a first cutout 42*a* of a fuel guide member 40 is increased, the total amount of fuel injected from all the fuel injection holes 11(A) in the middle section can be increased. In contrast to the above, with regard to the fuel injection holes 11 of each of the groups G1 and G2, by reducing the number of fuel injection holes 11(A) in the middle section thereof and decreasing the cutout width of the first cutout 42*a* of the fuel guide member 40, the total amount of fuel injected from all the fuel injection holes 11(A) in the middle section can be reduced. In this arrangement, if the diameter of each of the fuel injection holes 11 is set small, the atomization of injected fuel can be promoted, and if the diameter is set large, the amount of fuel injected can be increased.

Embodiment 3

Figure 9:
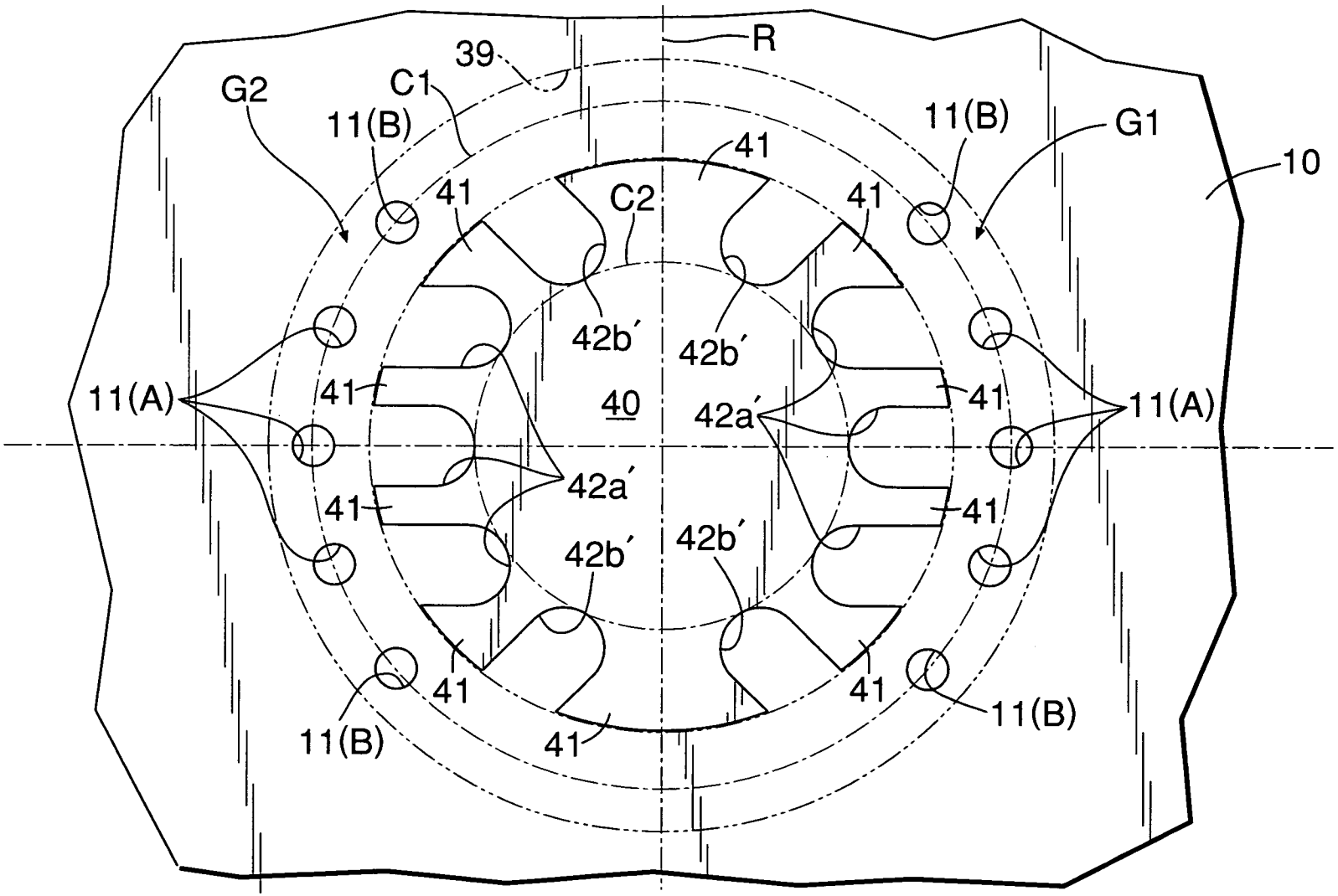
FIG. 9 is a view, corresponding to FIG. 4, showing a third embodiment of the present invention (third embodiment).

A third embodiment of the present invention shown in FIG. 9 is now explained.

In this third embodiment, with regard to fuel injection holes 11 of each group of an injector plate 10, a plurality of independent cutouts 42*a*' are provided in a fuel guide member 40 so as to correspond to a plurality of fuel injection holes 11(A) in a middle section, and cutouts 42*b*' are also independently provided for each of groups G1 and G2, the cutouts 42*b*' supplying fuel from the peripheral direction to fuel injection holes 11(B) in an outside section; apart from the above the arrangement of the third embodiment is the same as that of the first embodiment, and in FIG. 9 portions corresponding to those of the first embodiment are denoted by the same reference numerals and symbols, thus avoiding duplication of the explanation.

Embodiment 4

Figure 10:
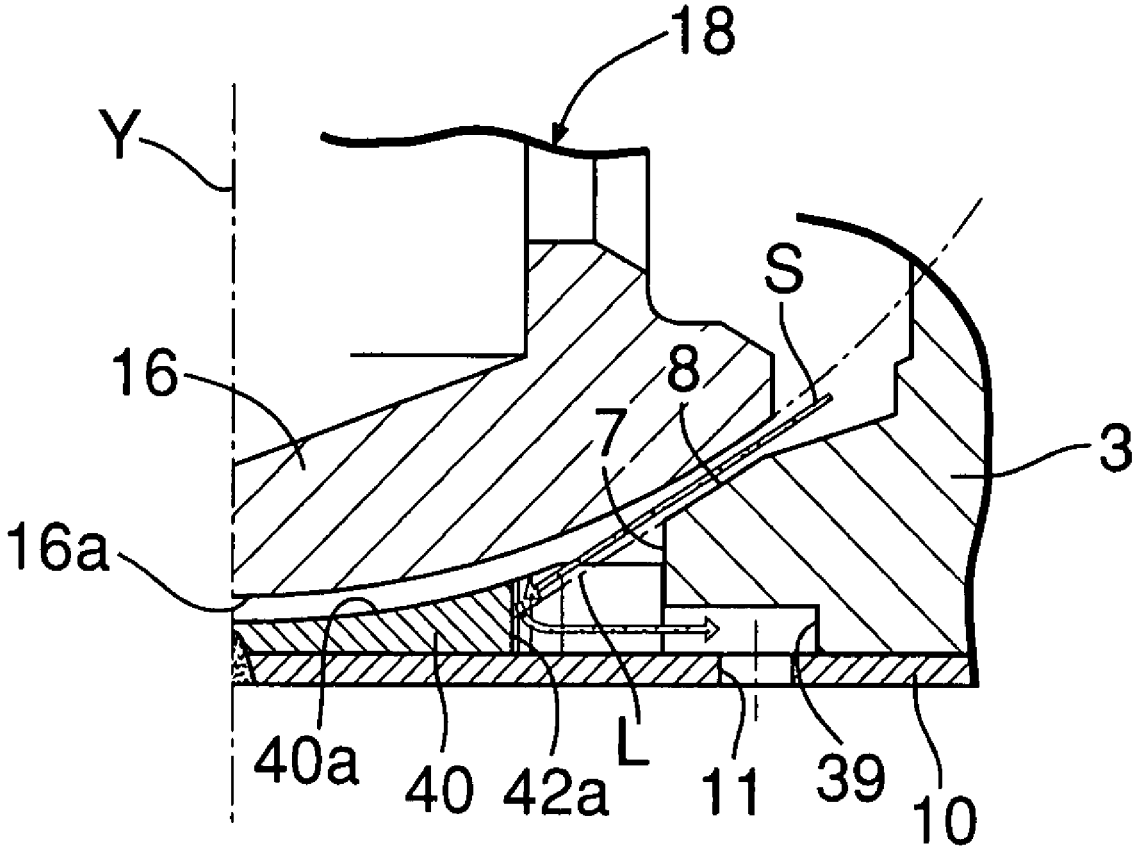
FIG. 10 is a view, corresponding to FIG. 3, showing a fourth embodiment of the present invention (fourth embodiment).

A fourth embodiment of the present invention shown in FIG. 10 is now explained.

In this fourth embodiment, an end face 40*a* of a fuel guide member 40 inserted into a valve hole 7 and a front end face 16*a* of a valve body 18 facing the valve hole 7 are formed as substantially concentric spherical faces; apart from the above the arrangement of the fourth embodiment is the same as that of the first embodiment, and in FIG. 10, portions corresponding to those of the first embodiment are denoted by the same reference numerals and symbols, thus avoiding duplication of the explanation.

Embodiment 5

Figure 11:
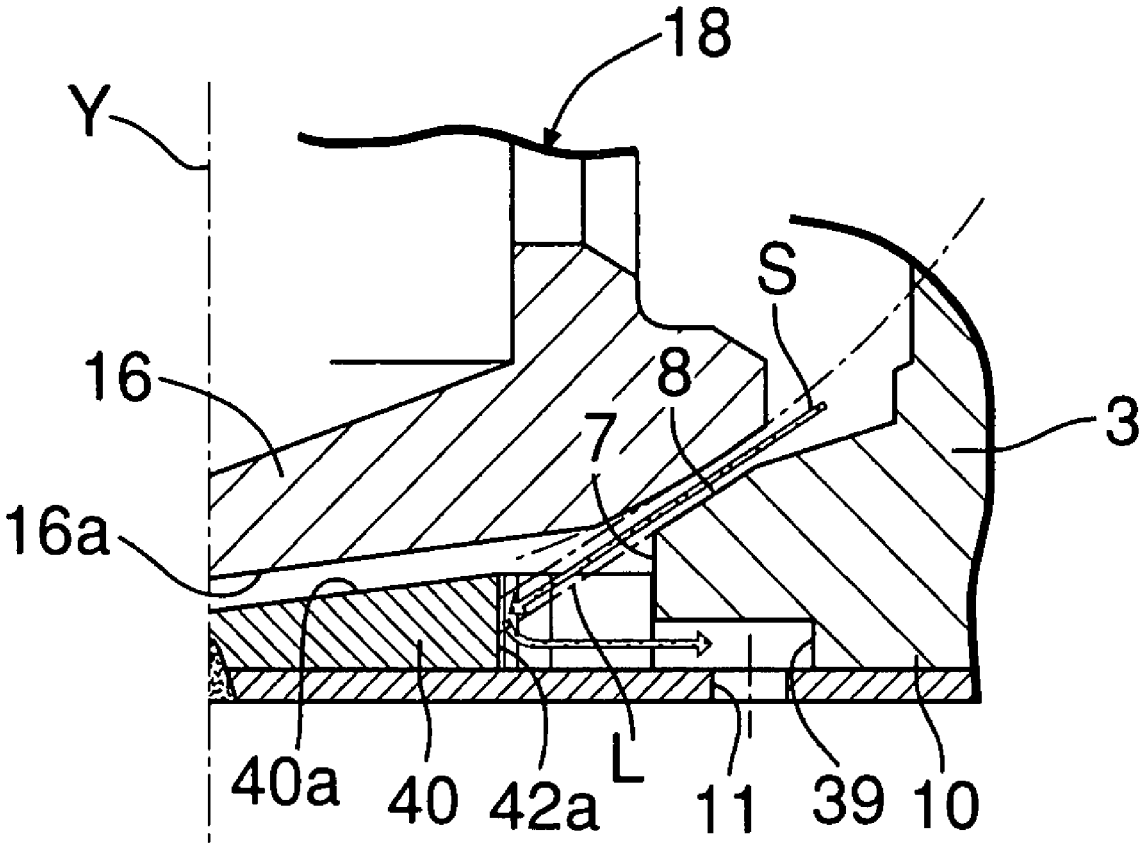
FIG. 11 is a view, corresponding to FIG. 3, showing a fifth embodiment of the present invention (fifth embodiment).

In a fifth embodiment of the present invention shown in FIG. 11, an end face 40*a* of a fuel guide member 40 inserted into a valve hole 7 and a front end face 16*a* of a valve body 18 facing the valve hole 7 are formed as conical faces that have a diameter decreasing toward an injector plate 10 side and have substantially the same conical angle; the arrangement of the fifth embodiment is otherwise the same as that of the first embodiment, and in FIG. 11, portions corresponding to those of the first embodiment are denoted by the same reference numerals and symbols, thus avoiding duplication of the explanation.

Embodiment 6

Figure 12:
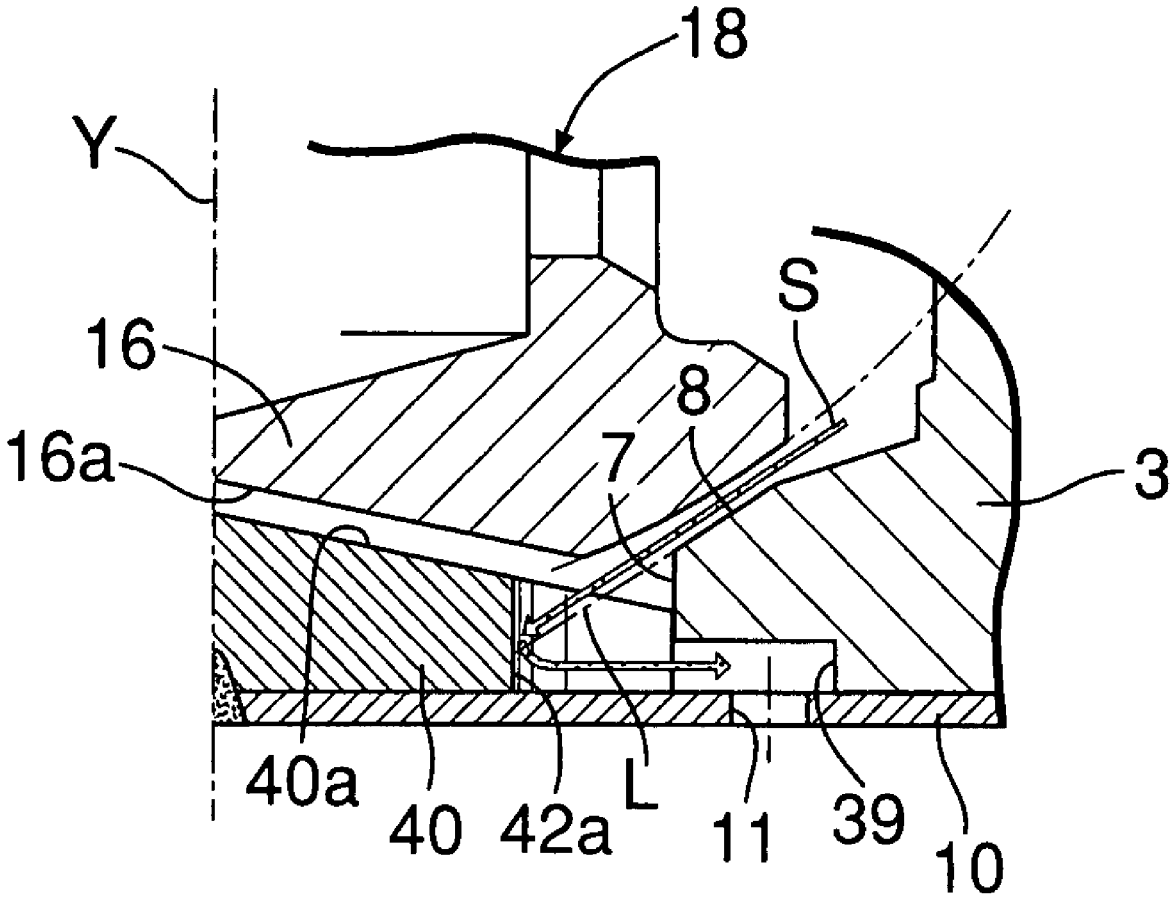
FIG. 12 is a view, corresponding to FIG. 3, showing a sixth embodiment of the present invention (sixth embodiment).

A sixth embodiment of the present invention shown in FIG. 12 has an arrangement in which an end face 40*a* of a fuel guide member 40 inserted into a valve hole 7 and a front end face 16*a* of a valve body 18 facing the valve hole 7 are formed as conical faces that have a smaller diameter side facing in a direction opposite to that in the fifth embodiment.

The present invention is not limited to the embodiments above and may be modified in a variety of ways as long as the modifications do not depart from the spirit and scope of the present invention. For example, a fuel injection hole 11 of each of groups G1 and G2 may be inclined in a range of 5° to 15°, relative to an axis Y of a valve seat member 3, toward a direction perpendicular to a diameter R, in response to a requirement for inclination, relative to the axis Y, of fuel spray forms F1 and F2 that are to be formed.

The invention claimed is:

1. A fuel injection valve comprising a valve seat member having a conical valve seat and a valve hole formed through a central part of the valve seat, a valve body for opening and closing the valve hole in cooperation with the valve seat, and an injector plate joined to the valve seat member and having a plurality of fuel injection holes radially outwardly displaced from the valve hole, a diffusion chamber providing communication between the valve hole and the fuel injection holes being provided between the valve seat member and the injector plate , wherein a fuel guide member facing the valve hole is connected to the injector plate, the diffusion chamber formed between the valve seat member and the injector plate has an annular shape, is faced by an outer peripheral face of the fuel guide member has a diameter that is larger than of the valve hole, and has inner ends of the fuel injection holes opening therein, the fuel guide member has formed in an outer peripheral portion a plurality of blocking portions partially blocking the valve hole and a plurality of cutouts that are present between blocking portions and provide communication between the valve hole and the diffusion chamber, and the cutouts are disposed to circumscribe an imaginary circle having a a center thereof on an axis (Y) of the valve seat member and the plurality of fuel injection holes are divided into two groups disposed symmetrically relative to a diameter (R) of the injector plate the fuel guide member is provided with first cutouts having a large cutout area and corresponding to a region in which a plurality of the fuel injection holes in a middle section of each of the groups are arranged, and second cutouts having a small cutout area and being positioned on the diameter (R) so as to face in opposite directions relative to each other, and the fuel injection holes in the outside section of each of the groups are disposed to face the respective blocking portions adjacent to the second cutouts.

2. The fuel injection valve according to claim 1, wherein when a total aperture area of the first cutouts is S1, a total aperture area of the second cutouts is S2, the valve-opening area between the valve seat and the valve body is S3, and total aperture area of the fuel injection holes is S4, S1 to S4 are set so as to make (S1+S2)>S3>S4.

3. The fuel injection valve according to either claim 1 wherein there are a plurality of the fuel injection holes arranged in the Middle section of each of the groups, one of the fuel injection holes is positioned in each of opposite outside sections of each of the groups, and a cutout width (W1) of the first cutout is set larger than the cutout width (W2) of the second cutout.

4. The fuel injection valve according to any one of claim 1, 2, 3, wherein the valve seat and the cutouts are disposed so that an extension (L) of the generatrix of the valve seat intersects an inner face of the cutouts.

5. The fuel injection valve according to any one of claims 1, 2, 3, wherein when an effective diameter of the valve seat is D1, and the diameter of the valve hole is D2, D1 and D2 are set so as to make 121 D1/D2≦ 1.5.

6. The fuel injection valve according to any one of claims 1,2,3, wherein the fuel guide member is inserted into the valve hole.

7. The fuel injection valve according to either claim 6, wherein an end face of the fuel guide member facing the valve hole is formed so as to follow an end face of the valve body facing the valve hole.

8. The fuel injection valve according to any one of claims 1, 2, 3, wherein when a height of the diffusion chamber is H1, and a thickness of the fuel guide member is H2, H1 and H2 are set to make H2/H1≧1.5.

9. The fuel injection valve according to any one of claims 1,2, or 3, wherein the fuel guide member is produced by press forming and is joined to the injector plate by spot-welding by means of a laser from an outer face side of the injector plate.

10. A fuel injection valve comprising a valve seat member having a conical valve seat and a valve hole formed through a central part of the valve seat, a valve body for opening and closing the valve hole in cooperation with the valve seat, and an injector plate joined to the valve seat member and having a plurality of fuel injection holes radially outwardly displaced from the valve hole, a diffusion chamber providing communication between the valve hole and the fuel injection holes being provided between the valve seat member and the injector plate, Wherein a fuel guide member facing the valve hole is connected to the injector plate, the diffusion chamber formed between the valve seat member and the injector plate is in an annular shape, is faced by an outer peripheral face of the fuel guide member, has a diameter that is larger than a diameter of the valve hole, and has inner ends of the fuel injection holes opening therein, the fuel guide member has formed in an outer peripheral portion a plurality of blocking portions partially blocking the valve hole and a plurality of cutouts that are present between blocking portions and provide communication between the valve hole and the diffusion chamber, the plurality of fuel injection holes are divided into two groups disposed symmetrically relative to diameter (R) of the injector plate wherein the plurality of cutouts are divided into first cutouts corresponding to a region in which a plurality of the fuel injection holes in a middle section of each of the groups are arranged and second cutouts positioned on the diameter (R) so as to face in opposite directions to each other, the fuel injection holes in an outside section of each of the groups are disposed to correspond to the respective blocking portions adjacent to the second cutouts, and flow rate of fuel that comes from the second cutout, which collides with an inner peripheral wall of the diffusion chamber, and is directed toward the fuel injection holes in the outside section is set higher than the flow rate of fuel that is directed from the first cutout toward the fuel injection holes in the outside section.

11. The fuel injection valve according to claim 10, wherein the fuel injection holes in the outside section are provided so that one thereof corresponds to each of the blocking portions.

12. The fuel injection valve according to claim 11, wherein the distance from the first cutout to the fuel injection hole in the outside section and the distance from the second cutout to the fuel injection hole in the outside section are set so as to be substantially equal to each other.

13. The fuel injection valve according to any one of claims 10 to 12, wherein the plurality of fuel injection holes are disposed on a common imaginary circle (C1) around an axis (Y) of the valve seat member.

14. The fuel injection valve according to any one of claims 10 to 12, wherein the plurality of fuel injection holes are distributed on a plurality of concentric imaginary circles (C1, C4) around an axis (Y) of the valve seat member(3).

15. The fuel injection valve according to any one of claims 10 to 12, wherein the fuel injection holes in the outside section are disposed closer to an inner peripheral wall of the diffusion chamber than midpoint between an outer peripheral face of the blocking portion and the inner peripheral wall.

* * * * *